United States Patent [19]

Kalbow

[11] 4,055,029

[45] Oct. 25, 1977

[54] CLEANING, SCOURING AND/OR POLISHING PADS

[76] Inventor: Heinz Kalbow, Lichgasse 46, D-5330 Konigswinter-Stieldorf, Germany

[21] Appl. No.: 662,349

[22] Filed: Mar. 1, 1976

[30] Foreign Application Priority Data

Mar. 7, 1975 Germany ..... 7507155[U]

[51] Int. Cl.[2] ..... B24D 15/04

[52] U.S. Cl. ..... 51/395; 51/401

[58] Field of Search ..... 51/394, 395, 396, 397, 51/398, 401, 402, 405, 407, 391, 392, 296, 297, 298; 15/244

[56] References Cited

U.S. PATENT DOCUMENTS

| | | | |
|---|---|---|---|
| 1,896,946 | 2/1933 | Gauss | 51/395 |
| 2,650,158 | 8/1953 | Eastman | 51/298 |
| 2,780,533 | 2/1957 | Hurst | 51/297 |
| 3,021,649 | 2/1962 | Robbins | 51/402 |
| 3,124,822 | 3/1964 | Marchese | 15/244 R X |
| 3,188,675 | 6/1965 | Beck | 15/244 R |
| 3,498,010 | 3/1970 | Hagihara | 51/395 |
| 3,540,160 | 11/1970 | DeRose | 51/394 X |

*Primary Examiner*—Harold D. Whitehead
*Assistant Examiner*—Nicholas P. Godici
*Attorney, Agent, or Firm*—Meyer, Tilberry & Body

[57] ABSTRACT

In a cleaning, scrubbing or polishing pad of the type formed from a pliable, flexible foamed plastic body having a scrubbing surface, the improvement of a plurality of protuberances on the scrubbing surface, each of the protuberances being defined by peripheral surfaces generally perpendicular to and forming generally sharp edges with an upper scrubbing surface of the protuberance.

5 Claims, 3 Drawing Figures

CLEANING, SCOURING AND/OR POLISHING PADS

The invention relates to the art of foam plastic elements or pads for cleaning, scouring and/or polishing purposes and the like, which pads consist of a flexible foam plastic material compounded so as to be pliable and having a contoured working surface.

Numerous constructional forms of domestic sponges made of foam plastic material are known for cleaning, scouring and polishing. These sponges comprising a working surface having an abrading, rubbing or polishing action. For this purpose, the flexible foam plastic element or pad which is compounded so as to be pliable is sometimes provided with a separate surface covering or coating, which has the required abrading or polishing properties. It is also known to use finely powdered abrasives or the like to be incorporated in the foam plastic material at the time of foaming or applied to the pad by means of an adhesive at the surface of the foam plastic element or pad. Furthermore, foam plastic sponges are also known which consist of a composite foam plastic element of several foam plastic layers of different hardness.

The known foam plastic elements or pads for cleaning, scouring and polishing usually comprise a smooth working or scrubbing surface which is not generally flat. However, foam plastic elements or pads are known which have a contoured scrubbing surface. In this case, distinctly rounded protuberances and depressions are formed on the scrubbing surface of the foam plastic pad. The invention is a foam plastic sponge or a foam plastic element or pad of the last-mentioned type, which has a contoured working or scrubbing surface. The invention has for its main object provision of a contoured working or scrubbing surface for the foam plastic element or pad, which surface is more effective in cleaning, scouring and/or polishing and which provides an economical foam plastic element pad which has improved properties in use.

The invention is characterized in that protuberances or bosses, which have sharp edges, are arranged on the contoured working or scrubbing surface of a foam plastic element or pad. These bosses or protuberances, in the preferred embodiment, have a polygonal contour shape or form, more particularly a rectangular or square form. The shaping of the bosses, which are formed on the scrubbing surface of the foam plastic element or pad, is done so that the peripheral edge surfaces of the bosses are disposed approximately at right angles to the upper surfaces of the bosses. This gives the bosses sharp contour or peripheral edges which are instrumental in increasing the efficiency of the bosses during cleaning, scouring or polishing.

The foam plastic element or pad according to the invention comprises a plurality of boss-like protuberances with sharp contour or peripheral edges distributed over the working surface of the pad, which protuberances, as a result of the deformation occurring in use of the pliable and flexible foam plastic element and the oblique position of the bosses which is a result thereof, develop a particularly pronounced and effective scouring or rubbing action on the surface to be treated. As a result of this improved action, considerably better cleaning or scouring action is accomplished. The arrangement of the boss-like protuberances and the shaping thereof also permits an effective treatment of extremely uneven surfaces. Parts of the surface to be cleaned, scoured or polished and to which access is difficult, as for example depressions, corners or reentrant angles, can be reached with the improved pad without any particular difficulties.

The boss-like protuberances can be readily formed from the open-cell foam material of the foam plastic pad. This can be done at comparatively low cost, for example, by cutting into the surface of the foam plastic element or pad by means of parallel sawing tools. The protuberances can be formed by means of a hot mould die, which melts the plastic to form depressions or grooves situated between the bosses. In this manner, there is provided a consolidation of the melted plastic to give better tensile strength at the surface of the sponge element melted by the fusion effect of the hot die. Other processes known in the foam plastic art can be used for shaping the protuberances on the surface of the foamed plastic pad. The profiling of the working or scrubbing surface of the foam plastic element or pad is advantageously effected by a plurality of narrow, intersecting grooves or the like being formed in the surface of the foam plastic element.

In accordance with another aspect of the present invention, a coating with a material which has a grinding or abrasive action is applied to the boss-like protuberances which are formed on the open-cell foam plastic element or pad. The coating is disposed substantially only on the upper surfaces of the boss-like protuberances and in the region of their contour edges. This material can form the edges themselves. The coating of the boss-like protuberances is preferably a fine-grain grinding or scouring agent, or the like, applied by an adhesive to the surface of the losses, so that after the adhesive has hardened, the fine-grain grinding or scouring agent in the adhesive is bonded to a greater or lesser degree to the upper surface of the bosses. Accordingly, it is another important aspect of the invention that the conventional materials used as grinding or scouring agent is a hard foam plastic material in powder form, which can be obtained by comminution of foam plastic elements which are compounded to be hard, such as those consisting of polyurethane foam. This abrasive, powdered or particulate form is harder than the pliable foam forming the body of the pad. Such a fine-grain hard foam material is generally softer or more pliable than the surface to be treated, but has, at the points of rupture of the cell walls, sharp cell wall edges which develop a pronounced scraping effect on being triturated on to the surface to be treated. On the other hand, the fine-grain foam plastic material with the thin cell walls is so brittle that the sharp edges break off under a relatively strong bearing pressure. This adds to the polishing effect of the pad. By using such an abrasive material, it is possible for even sensitive surfaces, such as metal surfaces, lacquer or synthetic plastic surfaces, to be rubbed thoroughly but at the same time gently, without any undesired scratching of the surfaces undergoing the rubbing. This hard foam plastic material which it is preferably used in accordance with the invention has a grain size in the range of about 50 to 500$\mu$, and more specifically in the range of about 100 to 200$\mu$.

For scouring or scraping of a surface, firstly the upstanding, free surfaces of the boss-like protuberances and secondly the peripheral edges of the protuberances are used. In accordance with one aspect of the invention, the peripheral edges of the boss-like protuberances are strengthened by the applied abrasive material and have a particularly pronounced scouring effect.

It is advisable for the height of each of the boss-like protuberances from the reset of the pad body to be of such a dimension that the dimension is considerably smaller than the length of the edges thereof. The depth and breadth of the grooves, which are generally rectangular, are so chosen that they are always considerably smaller than the edge dimensions of the bosses. It is recommended that the grooves should be of such a depth dimension that the depth is at least equal to the breadth of the groove. It is preferred that the depth be larger than the breadth of the grooves. Generally, the breadth of the grooves will be about 2 to 5 mm. Preferably the depth is 2 to 3 mm. In addition, the depth is about 1.5 to 3 times larger than the said breadth dimension. With square bosses, the length of the boss edge is preferably about 3 to 8 times the breadth or width of the grooves. More precisely, the depth is in the range of 4 to 6 times the breadth of the groove.

The foam plastic element according to the invention is capable of versatile use for cleaning, scouring and polishing purposes and for similar purposes. It has particular advantage for use as a so-called domestic sponge, for example, as a dish-washing or scouring sponge, or even for the treatment of sensitive lacquer, synthetic plastic or metal surfaces and the like.

One preferred constructional example of the invention is shown in the drawing, wherein.

Figure 1:
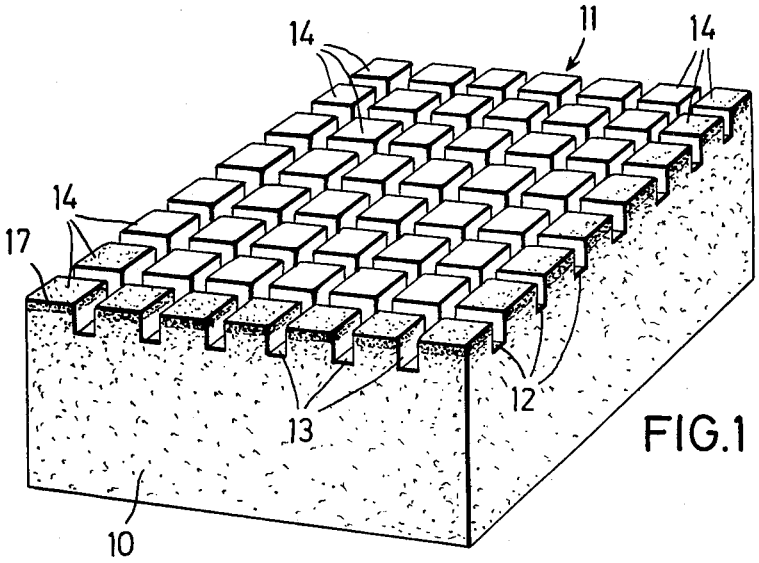
FIG. 1 is a perspective view showing somewhat schematically a foam plastic element according to the invention.

Referring now to the drawings, wherein the showings are for the purpose of illustrating a preferred embodiment of the invention only and not for the purpose of limiting same, FIG. 1 shows a foam plastic sponge which is an open-cell foam plastic element or pad 10. Preferably, pad 10 is formed from polyurethane foam which is compounded to be pliable. Other synthetic foamed plastics could be used for the pad. In the illustrated embodiment, foam plastic element or pad 10 has the form of a square, such as that which is normal for domestic sponges. The profiled top, working or scrubbing surface of foam plastic element 10 is indicated at 11. Formed in this surface of the foam plastic element 10 is a plurality of parallel grooves 12 and 13. Grooves 12 intersect grooves 13 at an angle of 90°. Consequently, rectangular or square boss-like protuberances 14 are formed by the grooves in the working or scrubbing surface of foam plastic element 10. The height of each of the protuberances is illustrated as being generally equal to the depth of grooves 12 and 13. The grooves 12 and 13 have a depth and breadth which is always considerably smaller than the edge dimensions of bosses 14. The breadth of the grooves 12 and 13 is generally about 2 to 5 mm. Preferably, the breadth is in the range of 2 to 3 mm. The depth is about 1.5 to 3 times greater than this breadth dimension under normal circumstances. The edge dimension of bosses 14 is about 3 to 8 times, and preferably 4 to 6 times, larger than the breadth of the grooves.

Grooves 12 and 13 can be formed into the surface of the foam plastic element or pad 10 by using parallel sawing tools for cutting the grooves. However, it is also possible to use a hot shaping die for the forming of the working surface 11. The die melts the foam plastic material at those positions necessary to form grooves 12 and 13.

The working or scrubbing surface 11 of foam plastic element or pad 10, contoured as explained, is provided with a covering or coating comprising a material which has a scouring, grinding or abrasive action. For these purposes it is preferable to use a finely powdered foam plastic material, which is obtained by comminution of a hard foam plastic, consisting for example of polyurethane compounded to be harder and more rigid than the foam of the body of pad 10. The finely powdered hard foam plastic material is used in a grain size preferably in the range of about 100 to 200$\mu$. A water-insoluble adhesive is added to the powdered abrasive material and the mixture can be applied by an applicator roller to the surfaces of bosses 14. The mixture partially penetrates into the open pores of the previously foamed plastic material. This surface coating of the bosses 14 is indicated at 15 in FIGS. 2 and 3. The hard foamed plastic particles bonded into the adhesive are made visible in FIG. 3 by the fine dots.

The application of abrasive materials or of the finely comminuted hard foam plastic material is preferably accomplished by mixing with a synthetic plastics adhesive, such as a polyurethane two-component adhesive with solvent and a solid content in the range of about 20%. Such an adhesive, which is commercially available, has a certain flexibility, even after curing, which is advantageous for the purpose to which the foam plastic element is adapted. Up to 50% by weight, preferably about 20 to 30% by weight, of abrasive material (particulated hard foam plastics material) is added to the adhesive. Thereafter the viscous liquid mass is applied to the upper surfaces of the bosses 14. It is suggested that a dye be added to the mixture of abrasive agent and adhesive, so that the working or scrubbing surface 11 of pad 10 can be made easily recognizable and so as to impart an attractive appearance as a whole to the end product.

Figure 2:
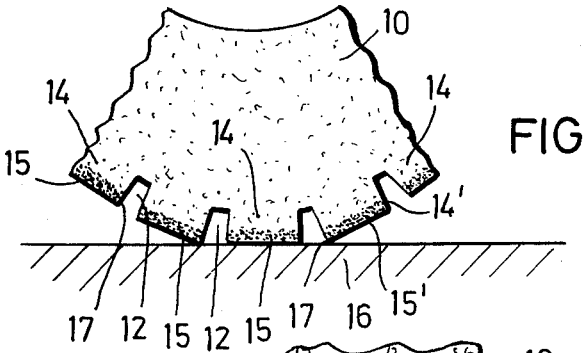
FIG. 2 is a partial enlarged view showing the foam plastic element or pad according to FIG. 1 in a deformed state during use; and, FIG. 3 is an enlarged cross-sectional view of a detail of the surface according to FIG. 2.
Figure 3:
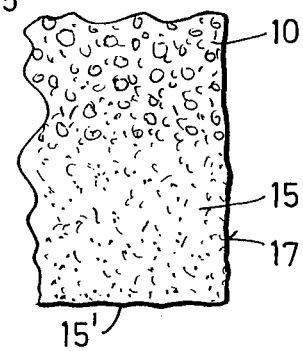

FIG. 2 shows the foam plastic element according to FIG. 1 in the deformed state while working on the surface 16. It can be seen that, because of the deformation of the pliable and elastic foam plastic pad 10, bosses 14 are set at an angle to one another by opening of the intermediate grooves. During working of the surface 16, the outer peripheral or contour edges 17 of the bosses 14 have a scraping action on surface 16. A particularly thorough cleaning or scouring effect is produced in this manner. Surfaces 15' of bosses 14, coated with the abrasive material, have a gentle scraping or grinding action on the surface 16. This action is considerably more gentle than the grinding or scraping action at edges 17, at which surfaces 15' and their flanks or peripheral surfaces 14' are at an angle of about 90° to one another. This surface intersection forms edges 17 as sharp edges. By the coating procedure, the foam plastic material, which is pliable and elastic, is somewhat strengthened in the upper surface region of bosses 14. This likewise has a favorable effect on the cleaning, scouring or polishing action.

Because of the elasticity of the foam plastic element or pad 10, the individual bosses 14 on the working or scrubbing surface 11 are able to be moved relatively to one another. As a result, the bosses can be adjusted to different angles relatively to one another. Consequently, it is also possible for irregular surfaces to be effectively rubbed with the cleaning or scouring sponge. The pad can be used on otherwise inaccessible surface regions of the surface to be treated, i.e. rubbed, cleaned, scoured or polished.

Pad 10 with the new working surface 11 may be mounted into a holder, in which it can remain while in use. Such a holder can be so designed that the foam plastic element 10 is held in the holder in an elastically deformed condition with a curved working surface, such as shown in FIG. 2. A foam plastic element, constructed in accordance with the invention and seated in a holder, can then be used in a manner similar to a brush. Pad 10 can be used as a scrubber or the like for cleaning floors. In that case, it could be mounted in a holder having a handle.

It is understood that the foam plastic element according to the invention can be of different dimensions and shapes, depending on the purpose for which it is used. It is also possible for two surfaces of the foam plastic element, generally the two opposite side surfaces thereof, to be formed with a working surface 11. It also being possible for the two working surfaces to be so prepared that one surface is suitable for a fine treatment and the other for a coarse treatment. It is understood that the two working surfaces 11 are, in such an application, to be coated with abrasive substances having different grinding or scouring properties.

Having thus defined the invention, it is claimed:

1. In a cleaning or polishing pad comprising a pliable flexible plastic body having open cells and a scrubbing surface, the improvement comprising: a plurality of protuberances on said scrubbing surface, each of said protuberances being defined by peripheral surfaces generally perpendicular to and forming generally sharp edges with an upper scrubbing surface of said protuberance; said sharp edges have given dimensions and said protuberances have a given height, with said dimensions being substantially greater than said height; said surface includes grooves between adjacent protuberances, each of said grooves having a depth and a breadth, said depth being substantially greater than said breadth; an abrasive layer on said upper scrubbing surfaces of said protuberances, said abrasive layer includes a particulate abrasive embedded in an adhesive.

2. The improvement as defined in claim 1 wherein said depth is approximately 1.5–3.0 times said breadth.

3. In a cleaning or polishing pad comprising a pliable flexible plastic body having open cells and a scrubbing surface, the improvement comprising: a plurality of protuberances on said scrubbing surface, each of said protuberances being defined by peripheral surfaces generally perpendicular to and forming generally sharp edges with an upper scrubbing surface of said protuberance; said sharp edges have given dimensions and said protuberances have a given height, with said dimensions being substantially greater than said height; an abrasive layer on said upper scrubbing surfaces of said protuberances, said abrasive layer includes a powdered foam plastic which is more hard than the foamed plastic of said body embedded in an adhesive.

4. The improvement as defined in claim 3 wherein said powdered foam plastic has a grain size of from about 50 microns to about 500 microns.

5. The improvement as defined in claim 3 wherein said powdered foam plastic has a grain size of from 100 microns to 200 microns.

* * * * *

UNITED STATES PATENT OFFICE
CERTIFICATE OF CORRECTION

PATENT NO. : 4,055,029

DATED : October 25, 1977

INVENTOR(S) : Heinz Kalbow

It is certified that error appears in the above-identified patent and that said Letters Patent are hereby corrected as shown below:

On the cover sheet Item [73] should read:

-- Collo GmbH, Bornheim-Hersel, Germany --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*